US008082742B2

(12) United States Patent
Broadbent et al.

(10) Patent No.: US 8,082,742 B2
(45) Date of Patent: Dec. 27, 2011

(54) ICE-MAKING MACHINE WITH WATER FLOW SENSOR

(75) Inventors: John Allen Broadbent, Centennial, CO (US); Richard Kepler, Aurora, CO (US); Ricky Rochleau, Denver, CO (US)

(73) Assignee: Mile High Equipment L.L.C., Denver, CO (US)

( * ) Notice: Subject to any disclaimer, the term of this patent is extended or adjusted under 35 U.S.C. 154(b) by 443 days.

(21) Appl. No.: 12/316,845

(22) Filed: Dec. 17, 2008

(65) Prior Publication Data

US 2009/0173085 A1 Jul. 9, 2009

Related U.S. Application Data

(60) Provisional application No. 61/007,864, filed on Dec. 17, 2007, provisional application No. 61/197,206, filed on Oct. 24, 2008.

(51) Int. Cl.
*F25C 1/00* (2006.01)
*G05D 23/32* (2006.01)

(52) U.S. Cl. ..... 62/66; 62/135; 62/157; 62/233

(58) Field of Classification Search ..... 62/66, 135, 62/157, 158, 233, 340
See application file for complete search history.

(56) References Cited

U.S. PATENT DOCUMENTS

| | | | | |
|---|---|---|---|---|
| 3,164,968 | A | 1/1965 | Mullins, Jr. | 62/73 |
| 3,228,202 | A | 1/1966 | Cornelius | 62/71 |
| 3,392,540 | A | 7/1968 | Council et al. | 62/138 |
| 3,740,963 | A | 6/1973 | Lyman et al. | 62/66 |
| 3,877,242 | A | 4/1975 | Creager | 62/138 |
| 3,988,903 | A | 11/1976 | Brewer et al. | 62/138 |
| 4,357,807 | A | 11/1982 | Aleksandrow | 62/228 |
| 4,510,761 | A | 4/1985 | Quarles | 62/73 |
| 4,884,413 | A * | 12/1989 | Quandt et al. | 62/135 |
| 5,193,357 | A | 3/1993 | Kohl et al. | 62/347 |
| 5,477,694 | A | 12/1995 | Black et al. | 62/73 |
| 5,479,707 | A | 1/1996 | Alvarez et al. | 29/890.039 |
| 5,606,869 | A | 3/1997 | Joo | 62/347 |
| 6,581,393 | B2 | 6/2003 | Newman et al. | 62/135 |
| 7,032,406 | B2 | 4/2006 | Hollen et al. | 62/347 |
| 7,082,782 | B2 | 8/2006 | Schlosser et al. | 62/347 |
| 2002/0157406 | A1 | 10/2002 | Billman et al. | 62/177 |
| 2005/0044875 | A1 * | 3/2005 | Schlosser et al. | 62/348 |

OTHER PUBLICATIONS

International Search Report issued Feb. 13, 2009 by the ISA/US for the corresponding International Application No. PCT/US2008/013791.
International Search Report issued Jun. 19, 2008 for the related International Application No. PCT/US2008/001340.
International Search Report issued Jul. 22, 2008 for the related International Application No. PCT/US2007/025582.
International Preliminary Report on Patentability issued Jan. 12, 2009 for the related International Application No. PCT/US2007/025582.

* cited by examiner

*Primary Examiner* — Chen Wen Jiang
(74) *Attorney, Agent, or Firm* — Ohlandt, Greeley, Ruggiero & Perle, L.L.P.

(57) ABSTRACT

The present disclosure provides an ice-making system having a control system. The control system selectively places the ice-making machine in a freeze cycle and a harvest cycle, based upon inputs from sensors that determine a flow rate of fluid out of an evaporator, and a level of fluid in a sump. The control system can further prevent a slushing condition in the ice-making machine by monitoring the temperature of the fluid in the sump. The control system can also monitor the sensors to ensure that they are providing correct signals.

13 Claims, 2 Drawing Sheets

ICE-MAKING MACHINE WITH WATER FLOW SENSOR

CROSS-REFERENCE TO RELATED APPLICATIONS

The present application claims the benefit of U.S. Provisional Application Nos. 61/007,864, filed on Dec. 17, 2007, and 61/197,206, filed on Oct. 24, 2008.

BACKGROUND OF THE DISCLOSURE

1. Field of the Disclosure

The present disclosure relates to ice-making machines. More particularly, the present disclosure relates to ice-making machines having an improved water flow sensor and harvest initiation control.

2. Discussion of the Related Art

In the field of ice-making machines, it is desirable to have automated machines that produce continuous supplies of ice, while still maintaining mechanical simplicity and efficient use of resources such as power and water during the ice-making process. The machines of the prior art, however, can require the use of costly and/or complicated mechanisms to control when the machines freeze and harvest the ice during the ice-making process.

Accordingly, there is a need for an ice-making machine that overcomes the aforementioned disadvantages of the machines of the prior art.

SUMMARY OF THE DISCLOSURE

The present disclosure provides an ice-making machine that can comprise a spiral-shaped, multi-tube evaporator. The evaporator has one or more water passages and one or more refrigerant passages disposed therein. Water and refrigerant are supplied to the evaporator, and the water is frozen by the conductive effects of the refrigerant while disposed within the evaporator. The ice-making machine of the present disclosure also comprises a first sump, a second sump, and a pump. Water that passes through the evaporator before it is frozen empties into the first sump.

The present disclosure also includes a control system that comprises a controller, flow sensors, sump sensors, and temperature sensors that can be disposed within the ice-making machine. Based on input from these sensors, the controller can place the machine in freeze or harvest mode, or prevent too much poor product, such as slush, from being produced by the machine. The present disclosure therefore provides a highly beneficial machine and control system for making ice, over what is available in current systems.

DETAILED DESCRIPTION OF THE INVENTION

Figure 1:
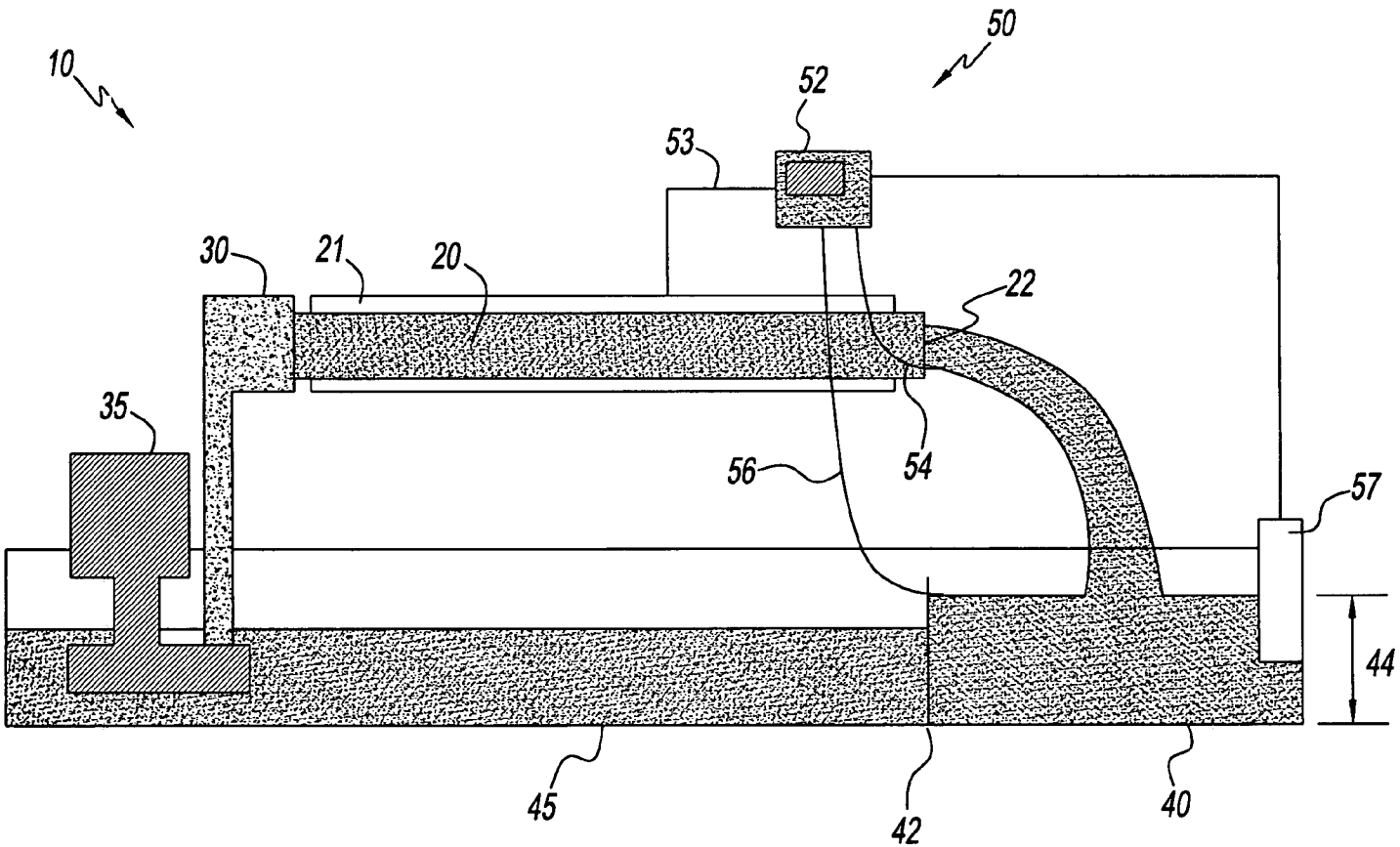
FIG. 1 is a schematic diagram of the ice-making machine of the present disclosure.
Figure 2:
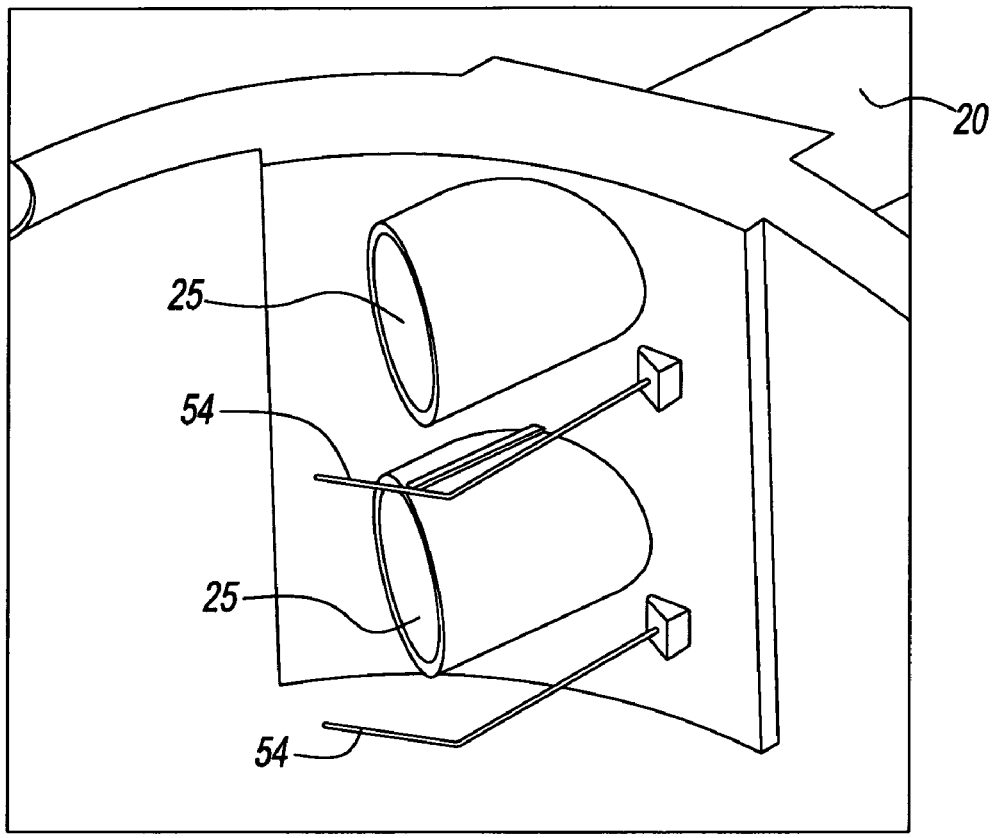
FIG. 2 is a perspective view of the outlets of the evaporator of the ice-making machine of FIG. 1.

Referring to FIGS. 1-2, an ice-making machine ("machine") 10 of the present disclosure is shown. Machine 10 further comprises evaporator 20, which can be covered with an insulating material 21, and a control system 50 which provides for automated initiation of the freezing and harvesting cycles within machine 10. Control system 50 comprises a controller 52, at least one flow sensor 54 disposed near an outlet of evaporator 20, and at least one sump sensor 56 disposed within a first sump 40. Flow sensors 54 and sump sensor 56 are in electrical communication with controller 52.

In one embodiment, flow sensor(s) 54 can be simple wire sensors that detect electrical continuity between evaporator 20 and the water flowing therefrom, so that it can determine when the flow of water is above or below a certain point. Similarly, sump sensor 56 can be disposed within first sump 40, and detect when a water level therein rises or drops below a certain level. Controller 52 is in communication with these sensors, and can use the inputs therefrom to determine when the freezing and harvest cycles should take place. The present disclosure thus provides a simple, low-cost control system that is easy to install and maintain, and which provides added efficiency to the making and harvesting of ice within machine 10.

The conductive wire used for flow sensors 54 is advantageous in that it is flexible, low cost, reliable, doesn't hinder the flow of ice out of evaporator 20, and is simple to install. The present disclosure, however, contemplates a number of possibilities for flow sensors 54, including proximity sensors, switches, contact sensors, capacitance sensors, vibration sensors, or others and combinations thereof, as long as the sensor doesn't hinder the flow of ice out of the evaporator.

During operation of machine 10, water is supplied to evaporator 20 through water tube 30, which is connected to a first end of evaporator 20. For example, water can be supplied through water tube 30 with pump 35, as will be discussed in further detail below. Refrigerant is also supplied to evaporator 20 by one or more refrigerant inlet pipes (not shown). Refrigerant flows through one or more refrigerant passages (not shown), which are disposed within evaporator 20. The refrigerant inlet pipes can be in communication with a refrigerant compression circuit.

The water that is supplied by water tube 30 flows through one or more water passages 25, which are also disposed within evaporator 20, and are adjacent to, and in thermal communication with, the refrigerant passages. In the shown embodiment, there are two water passages 25. Water flowing through water passages 25 is thus frozen by the refrigerant passing through the refrigerant passage(s). The water within passages 25 can freeze at the outer edges first, and grow toward the middle, until the desired thickness of ice has been reached. This substantially stops the flow of water through water passages 25.

While the water within passages 25 is freezing, the water that is not frozen and passes through exits at an end 22 of evaporator 20, and is collected in first sump 40. As shown in detail in FIG. 1, flow sensors 54 are disposed at end 22 of evaporator 20, and are connected to, and in electrical communication with, controller 52. Another device of electrical communication, such as a wire 53, connects controller 52 to evaporator 20. When the water exiting evaporator 20 comes into contact with flow sensors 54, a circuit defined by wire 53, evaporator 20, water exiting evaporator 20, and flow sensors 54 remains continuous. When there is no water in contact with flow sensors 54, the electrical circuit is broken, and this is detected by controller 52. Since the drop in flow of water out of evaporator 20 signals that the water within is substantially frozen, controller 52 will initiate a harvest mode. This can entail, for example, passing warm refrigerant through the refrigerant passages, which will loosen the ice disposed within water passages 25. This ice is then ejected due to the pressure of the water entering the evaporator. This ice can be routed and collected via another device, namely a drop zone, that is the subject of a co-pending application 61/197,735.

As shown in FIG. 2, flow sensors 54 are positioned so that they will detect when the flow of water out of evaporator 20 drops below a certain rate, but before the flow stops completely. This helps to ensure that water is always flowing out of evaporator 20, and prevents a situation where the water is completely frozen within water passages 25. An "over-freeze" situation within evaporator 20 can harm the evaporator. Water that is pinched off with ice within evaporator 20 before being frozen and prevented from flowing out of evaporator 20 will expand and deform it. The location of flow sensors 54 therefore helps to prevent this situation. In addition, as a further preventative measure, the valve that allows hot gas to flow through evaporator 20 can be of the normally-open type. In the event of a power loss, the normally-open hot gas valve will open, allowing warm refrigerant into evaporator 20, and preventing the potential over-freeze situation. This provides an additional safeguard against an over-freeze in evaporator 20.

Once the ice has been completely ejected from evaporator 20, water will flow out at its maximum rate. First sump 40, flow screen 42, and second sump 45 are designed so that water leaves evaporator 20, flows into first sump 40, through flow screen 42, into second sump 45, and to pump 35, where it is pumped back into evaporator 20 through water tube 30. Flow screen 42 has a porosity, which impedes the flow of water enough so that first sump 40 will begin to fill up and reach a set maximum level 44, when there is a maximum flow of water out of evaporator 20. Again, this will only happen when there is no ice disposed within evaporator 20, i.e. at the end of the harvest cycle. Sump sensor 56 will detect when the water within first sump 40 reaches level 44, and send a signal to controller 52, which will in turn initiate a freezing mode for machine 10.

Thus, control system 52 will only place machine 10 in freezing mode when all three of the sensors—i.e. the two flow sensors 52, and sump sensor 56—detect the presence of water. This condition signals that evaporator 20 is completely cleared of ice, and that the water within first sump 40 has reached maximum level 44. Table 1 below summarizes the modes initiated by control system 50, depending on the status of each of the sensors.

TABLE 1

| | | | | |
|---|---|---|---|---|
| First flow sensor 54 | X | X | ○ | ○ |
| Second flow sensor 54 | X | ○ | X | ○ |
| Sump sensor 56 | X | ○ | ○ | ○ |
| Mode | F | H | H | H |

X—indicates that the sensor is in contact with water
○—indicates that no water is contacting the sensor
F—freeze mode
H—harvest mode Control system 50 can also assist with the prevention of unmanageable levels of slush that is produced by machine 10. Slush can be defined as a water/ice slurry. During the initial stages of the freezing process, the velocity of water through evaporator 20 is high, and it skims over the smooth surface within the water passage 25. In this situation, the water has a tendency to subcool below its freezing temperature. When ice crystals do begin to form, the water in the system will tend to form into this slush/slurry. Slush can harm an ice-making machine, or at least adversely affect the efficiency of the machine, because it is an undesirable final product, and can clog the components of machine 10, such as flow screen 42 and/or pump 35. A temperature sensor, such as a thermistor 57, is in electrical communication with controller 52, is disposed within first sump 40, and detects the temperature of the water therein. When the temperature of the water being circulated through evaporator 20 and expelled into first sump 40 reaches 33° F., controller 52 turns off pump 35 for a short period of time. In one embodiment this time is about 40 seconds. Depending on the configuration of the machine, this off-time could be slightly shorter or longer, for example from about 25 seconds to about 1.5 minutes. This off-time allows the evaporator to sub-cool significantly, due to the effects of the refrigerant being passed through it, to a temperature that is significantly below freezing. When pump 35 is turned back on, a portion of the water that passes through evaporator 20 turns to slush, and will be expelled into first sump 40. This method will create a relatively small, manageable amount of slush that will not clog the system. Slush that is formed during this time will float in the sump and melt during the remainder of the ice making cycle.

Control system 50 also has a feature whereby it checks to make sure that the flow sensors 54 and the sump sensor 56 are providing correct signals. This is done by monitoring the sensors when it is known that they should be in a certain condition. For example, when pump 30 is turned off, as described in the previous paragraph, the flow of water through evaporator 20 is halted. By the end of the off-time, flow sensors 54 should be dry, and controller 52 will check to make sure that they are giving the appropriate signal. During this off-time, controller 52 will not trigger the harvest condition since it is known that the ice is not ready at this point. For sump sensor 56, the controller can check to see its status when the machine enters a harvest cycle. At this point, there should be minimal water flow exiting evaporator 20, so the level of water within first sump 40 should be at a minimum. Therefore, at this point, sump sensor 56 should not be in contact with any water. If the signal from any of the sensors is erroneous, control system 50 will shut machine 10 down. This check on the sensors within machine 10 performed at the beginning of each freeze and harvest cycle, and also helps to prevent an over-freeze situation within evaporator 20.

While the instant disclosure has been described with reference to one or more exemplary or preferred embodiments, it will be understood by those skilled in the art that various changes may be made and equivalents may be substituted for elements thereof without departing from the scope thereof. In addition, many modifications may be made to adapt a particular situation or material to the teachings of the disclosure without departing from the scope thereof. Therefore, it is intended that the disclosure not be limited to the particular embodiment(s) disclosed as the best mode contemplated for carrying out this invention, but that the invention will include all embodiments falling within the scope as described herein.

What is claimed is:

1. A control system for an ice-making machine, wherein the ice-making machine comprises an evaporator and a sump, wherein fluid flows through said evaporator and into said sump, the control system comprising:

a controller;

at least one flow sensor to detect a flow of fluid exiting said evaporator; and a sump sensor to detect a level of fluid disposed in said sump, wherein said at least one flow sensor and said sump sensor are in electrical communication with said controller, wherein said controller controls said ice-making machine to enter a freezing cycle to freeze said fluid, or a harvest cycle to harvest said frozen fluid, based upon inputs from said at least one flow sensor and said sump sensor, and wherein said controller controls said ice-making machine to enter said freezing cycle if said at least one flow sensor detects that said flow of fluid is above a first amount, and said sump sensor detects that said level of fluid is above a second amount.

2. The control system of claim 1, wherein said ice-making machine enters said harvest cycle if said at least one flow sensor detects that said flow of fluid is below said second amount, or said sump sensor detects that said amount of fluid in said sump is below said second amount.

3. The control system of claim 2, wherein said first amount is greater than zero.

4. The control system of claim 2, wherein said controller monitors said sump sensor at the end of said harvest cycle, to determine that said at least one flow sensor is providing a correct signal.

5. The control system of claim 1, wherein said at least one flow sensor is selected from the group consisting of proximity sensors, switches, contact sensors, capacitance sensors, wire contact sensors, or combinations thereof.

6. The control system of claim 5, wherein said at least one flow sensor is a wire contact sensor that is in electrical communication with said evaporator.

7. The control system of claim 6, wherein said controller and said evaporator are in electrical communication.

8. The control system of claim 1, wherein said ice-making machine further comprises a pump for circulating said fluid through said evaporator, said control system further comprising:

a temperature sensor disposed within said sump for measuring a temperature of said fluid disposed therein, wherein said temperature sensor is in electrical communication with said controller, and wherein said control system turns off said pump for a period of time when said temperature of said fluid disposed in said sump reaches about 33° F.

9. The control system of claim 8, wherein said period of time is between about 25 seconds to about 90 seconds.

10. The control system of claim 9, wherein said controller monitors said at least one flow sensor at the end of said period of time, to determine that said at least one flow sensor is providing a correct signal.

11. A method of operating an ice-making machine, wherein said ice-making machine comprises an evaporator and a sump, wherein a fluid flows through said evaporator and into said sump, the method comprising the steps of:

detecting a flow of said fluid out of said evaporator;

detecting a level of said fluid in said sump; and controlling said ice-making machine to enter a freezing cycle to freeze said fluid, or a harvest cycle to harvest said fluid after it has been frozen, based on the results of said detecting steps, wherein said controller controls said ice-making machine to enter said freezing cycle if said flow of said fluid out of said evaporator is above a first amount, and said level of said fluid in said sump is above a second amount.

12. The method of claim 11, wherein said ice-making machine enters said harvest cycle if said flow of said fluid out of said evaporator is below a first amount, or said level of said fluid in said sump is below a second amount.

13. The method of claim 11, further comprising the steps of:

pumping said fluid through said evaporator;

measuring a temperature of said fluid in said sump;

pausing said pumping of said fluid through said evaporator for a period of time, if said temperature of said fluid reaches about 33° F.

* * * * *